US006212355B1

(12) United States Patent
Bunn et al.

(10) Patent No.: US 6,212,355 B1
(45) Date of Patent: Apr. 3, 2001

(54) OIL METERING SUPPLY APPARATUS AND METHOD FOR APPLYING AN EVENLY DISTRIBUTED RELEASE OIL ONTO A FUSER ROLLER

(75) Inventors: Thomas G. Bunn, Williamsburg; Kristin Brady Cusolito, Virginia Beach, both of VA (US)

(73) Assignee: Tex Tech Industries, Hampton, VA (US)

( * ) Notice: Subject to any disclaimer, the term of this patent is extended or adjusted under 35 U.S.C. 154(b) by 0 days.

(21) Appl. No.: 09/379,117

(22) Filed: Aug. 23, 1999

(51) Int. Cl.[7] ..... G03G 15/20
(52) U.S. Cl. ..... 399/325
(58) Field of Search ..... 399/324, 325

(56) References Cited

U.S. PATENT DOCUMENTS

| | | | | |
|---|---|---|---|---|
| 3,718,116 | | 2/1973 | Thettu . | |
| 3,831,553 | | 8/1974 | Thettu . | |
| 3,964,431 | * | 6/1976 | Namiki | 399/325 X |
| 4,309,957 | | 1/1982 | Swift . | |
| 4,429,990 | | 2/1984 | Tamary . | |
| 4,668,537 | | 5/1987 | Matsuyama et al. . | |
| 4,751,548 | * | 6/1988 | Lawson | 399/325 |
| 4,908,670 | | 3/1990 | Ndebi . | |
| 5,232,499 | * | 8/1993 | Kato et al. | 399/325 |
| 5,267,004 | | 11/1993 | Mills . | |
| 5,478,423 | | 12/1995 | Sassa et al. . | |
| 5,482,552 | * | 1/1996 | Kikukawa et al. | 399/325 |
| 5,534,062 | | 7/1996 | Dawson et al. . | |
| 5,534,986 | * | 7/1996 | Irro et al. | 399/325 |
| 5,594,540 | | 1/1997 | Higaya et al. . | |
| 5,709,748 | | 1/1998 | Sassa et al. . | |
| 5,853,823 | * | 12/1998 | Ishikawa | 399/325 X |
| 5,974,293 | * | 10/1999 | Fromm | 399/325 |
| 5,991,562 | * | 11/1999 | Ito et al. | 399/325 X |

FOREIGN PATENT DOCUMENTS

| | | |
|---|---|---|
| 0 479 564 A2 | 8/1992 | (EP) . |
| 2 242 431 | 2/1991 | (GB) . |
| 62-178992 | 8/1987 | (JP) . |

* cited by examiner

*Primary Examiner*—Fred L. Braun
(74) *Attorney, Agent, or Firm*—Larson & Taylor PLC

(57) ABSTRACT

An apparatus for evenly distributing a layer of release oil on the surface of a fuser roller so as to prevent paper from adhering to the fuser roller in an electrophotographic heated imaging apparatus such as a printer or copier, and method for using this apparatus, is provided which includes a tank roller having a reservoir capable of retaining and delivering a release oil, an oil distribution layer surrounding the tank roller which can evenly distribute a layer of release oil along the outer surface of the tank roller, and a liquid permeation control layer made of a material such as expanded porous polytetrafluoroethylene which surrounds the oil distribution layer and which further controls the delivery of a release oil onto the surface of the fuser roller. The present invention is advantageous in that an evenly distributed layer of release oil may be applied to the fuser roller without the problems of streaking and dumping associated with prior art methods, and the use of a tank roller allows for a substantially larger volume of oil to be used and is more simply and efficiently recycled and/or refilled when compared to prior art devices of similar dimensions. The oil metering supply device of the present invention is thus able to provide more oil in a smaller space and increase the overall life and cost-effectiveness of the part.

11 Claims, 2 Drawing Sheets

OIL METERING SUPPLY APPARATUS AND METHOD FOR APPLYING AN EVENLY DISTRIBUTED RELEASE OIL ONTO A FUSER ROLLER

FIELD OF THE INVENTION

This invention relates in general to a method and apparatus for applying a supply of release oil to a fuser roller in an electrophotographic imaging device such as a printer or copier, and in particular to an apparatus for supplying an evenly distributed layer of release oil to a fuser roller which is comprised of a tank roller or other geometrical design having a reservoir capable of retaining and delivering a release oil, an oil distribution layer wrapped around the tank roller made of a material such as a thermal-bonded temperature-tolerant non-woven fabric, and a liquid permeation control layer over the outer surface of the tank roller made of a material such as porous expanded PTFE film, and a method of using this apparatus in order to apply an evenly-distributed layer of oil to the fuser roller without streaking or dumping.

BACKGROUND OF THE INVENTION

In a typical electrophotographic imaging apparatus, such as a printer, copier, plain-paper facsimile machine, etc., a series of rollers are generally used in order to permanently affix an image once photographic toner has been applied to the paper or other recording medium. These rollers will usually be configured so that at least two rollers will be in contact with each other and will be rotatable in opposite directions, and the paper receiving the photographic image will be directed to pass between these two rollers. In this type of arrangement, one or both of the rollers will be designed to apply heat in order to permanently fix the image on the paper, and this fixing step will be further aided by having at least one of these rollers made of a resilient material so that it will apply a sufficiently high pressure to the paper simultaneously with the heat. In this configuration, the roller applying the heat to the recording medium is generally known as a "fuser roller", and the resilient roller applying pressure to the paper is thus referred to as the "pressure roller."

In these electrophotographic heated imaging devices, it is thus necessary to apply sufficient heat and pressure to ensure that the photographic toner is permanently affixed to the paper in order to produce the final image. However, because of these extreme heat and pressure conditions, there is also a great tendency for the paper to stick to the heated fuser roller during the copying process, and this tendency to stick must be overcome in order to ensure the proper functioning of the heated imaging device.

In general, to overcome the problem of sticking to the fuser roller, these heated imaging devices typically will use a release agent such as silicone oil which is applied to the surface of the fuser roller in a manner which eliminates or reduces the tendency of the paper to stick during the fusing step. At present, there are many products used in the industry to supply the oil to the fuser roller. Higher quality printing and color printing has driven a need for consistency in the oil laydown. Previous designs of oil supply sources were temperature-tolerant felt pads (often made from aramid fibers), rollers with metal cores wrapped with aramid felts and oiled, oiled ceramic core rollers wrapped with aramid felt, and metal core tank rollers with holes that allowed oil to flow to the aramid felt wrap.

Unfortunately, none of these prior art devices are suitable for providing a consistent and even distribution of release oil onto the surface of a fuser roller. For example, the problem with devices featuring a felt-wrapped oil supply source is their inconsistency. As the oil is applied to the fuser roller, the fibers of the felt often cause a streak pattern on the final image. This pattern can be seen on the printed page with a black light if a UV tracer is added to the oil when the supply device is fabricated. Thus, the amount of oil that flows out of these types of oil supply devices is also relatively uncontrolled. As the oil supply device comes in contact with the hot fuser, the viscosity of the oil is reduced and the oil flows onto the fuser unabated.

Another problem inherent in these prior art oil supply devices is what is referred to as oil "dumping." This condition refers to the large amount of oil transferred to the first few pages as the copier or printer is started. This happens because the oil supply source is in contact with the hot fuser while the machine is idle, and a pool of oil gets deposited. While the fuser is running a large batch job, the oil laydown may eventually improve in consistency, but this occurs at the sacrifice of the initial startup pages.

Even further, as machines increase print and copy resolution, and as color copies and prints become more common, a consistent source of release oil supply is imperative. These higher performance levels require a consistent oil laydown with no streaking or dumping. In the case of color, the oil laydown can affect the color consistency of the printed page and is a particular concern with transparencies.

In the patent arts, there have been many devices that have been disclosed for applying a release oil to the fixing roller of a copying or printing apparatus. These patent references include U.S. Pat. Nos. 5,534,062; 5,478,423; 5,709,423; 5,232,499; 5,594,540; 4,668,537; 4,309,957; 4,908,670; 5,267,004; 3,831,553; and 3,718,116. In addition, such devices are disclosed in foreign patent references Eur. Pat. App. 479,664 and Japanese Laid-Open Patent No. 62-178992. In some of these patent references, devices have been disclosed which attempt to provide a suitable oil control layer made of materials such as polytetrafluoroethylene (PTFE), such as in Eur. Pat. App. 479,564, but these layers are used in conjunction with an open-celled foam interior which has an extremely limited oil capacity and which is extremely difficult to recycle or refill. Similarly, Japanese Patent reference no. 62-178992 discloses a device which consists of an oil permeation layer adhered to a thick porous material which serves as a wick or reservoir for supplying oil to the permeation control layer. Once again, the reservoir capacity of such devices are extremely limited, and in addition, have extremely limited lifetimes because of the deformation and failure of the thick porous material supporting the permeation control layer which limits performance and requires frequent replacement.

Accordingly, there is thus a substantial need in this field to develop a method and apparatus for applying a release oil to a fusing roller in a printer or copier which has a sufficiently large oil capacity, which can be simply and efficiently operated for an extended period of time, and which can ultimately safely and easily be recycled and/or refilled. There is also a substantial need to provide a means whereby a release oil can be applied to a fuser roller in such a manner as to obtain a consistent oil laydown with little or no streaking or dumping. Finally, there is a substantial need to provide a means for achieving an even distribution of oil onto a fuser roller in a printer or copier which avoids the many other problems associated with the prior art devices in this field.

SUMMARY OF THE INVENTION

It is thus an object of the present invention to provide an apparatus and method which can achieve a consistent laydown of oil onto a fuser roller in an electrophotographic heated imaging device which can reduce or eliminate the sticking of the paper recording medium to the fuser roller without causing problems such as streaking or dumping of the release oil.

It is also an object of the present invention to provide an apparatus for applying an evenly distributed layer of release oil onto a fuser roller in a printer or copier which is capable of holding a substantially larger volume of oil as compared to prior art devices of similar dimensions and provide more oil in a smaller space and thus increase the life of the part.

It is also an object of the present invention to provide an apparatus for applying release oil to a fuser roller which is simple, efficient and cost-effective, and which can simply and inexpensively be recycled or refilled when needed.

It is further an object of the present invention to provide an apparatus which can achieve consistent oil laydown in many types of printing or copying equipment, including those devices which reproduce color images and those which provide an image on transparencies.

It is still further an object of the present invention to provide an apparatus and method which will allow an even and uniform distribution of release oil onto a heated fuser roller so as to prevent the recording medium from adhering thereto, while at the same time avoiding the problems associated with prior art devices which would hinder the proper functioning of the electrophotographic imaging device.

These and other objects are obtained by virtue of the present invention which provides an oil metering supply device for supplying an evenly-distributed layer of release oil to a fuser roller comprising (a) a tank reservoir which can be in the form of a sealed cylindrical tube or other suitable geometric configuration and which has a specified hole pattern to allow oil to flow from the inner reservoir of the tank to its outer surface; (b) an oil distribution layer surrounding the tank roller which can be made of a material such as a thermal-bonded, temperature-tolerant, non-woven fabric, and which can evenly distribute a layer of release oil along the outer surface of the tank roller; and (c) a liquid permeation control layer surrounding the oil distribution layer which further controls the application of the release oil to the fuser roller and which can be made of a material such as a porous expanded PTFE film. In addition, a method for using this apparatus in order to achieve a consistent release oil laydown on a wide variety of printing and copying devices without the streaking or dumping associated with prior art methods is also provided.

BRIEF DESCRIPTION OF THE DRAWINGS

The present invention will now be described in detail with respect to preferred embodiments thereof, which are to be taken together with the accompanying drawings, wherein.

DETAILED DESCRIPTION OF THE PREFERRED EMBODIMENTS

Figure 2:
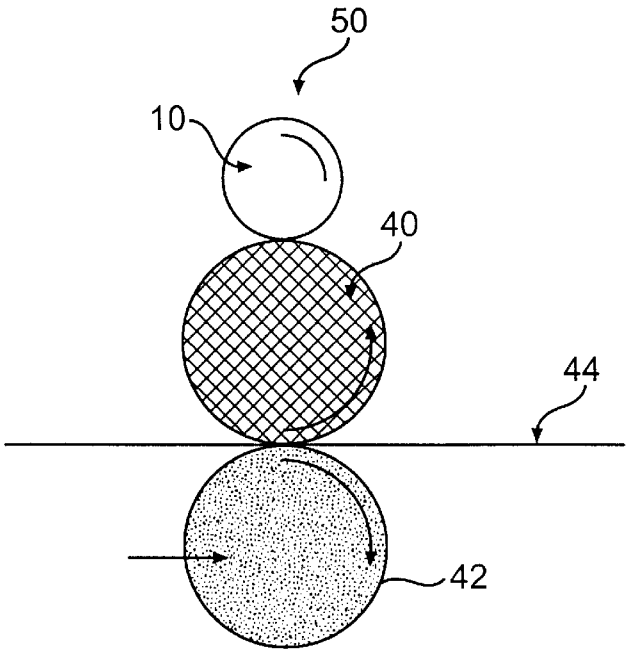
FIG. 2 is side schematic view which shows the portion of an electrophotographic imaging device incorporating the apparatus of the present invention.
Figure 1:
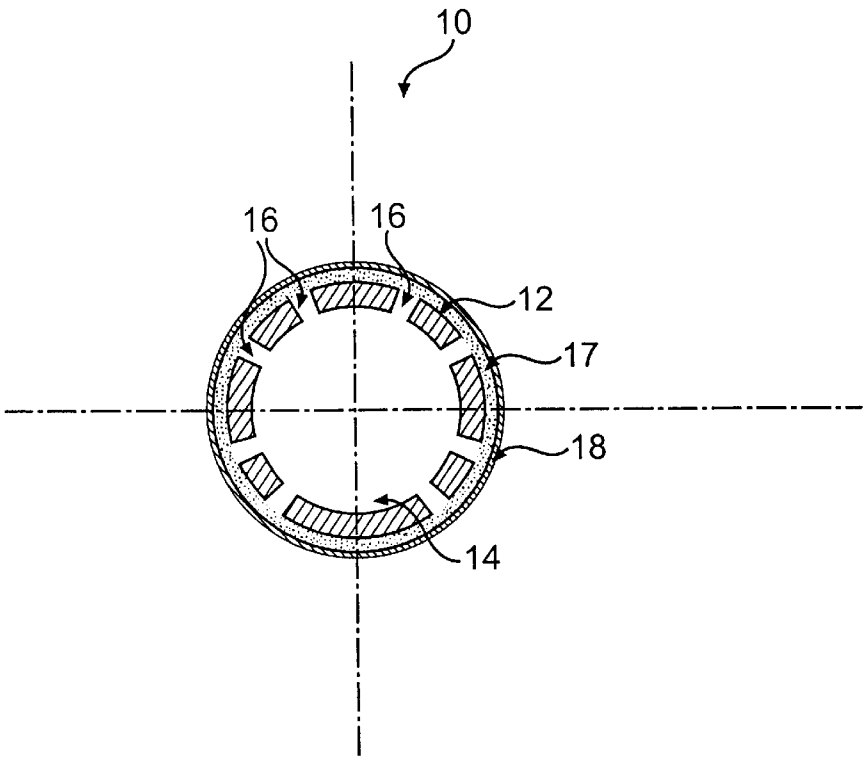
FIG. 1 is a side cross-sectional view of the preferred embodiment of the apparatus of the present invention.

In accordance with the present invention, an apparatus and method are provided for supplying a release oil to a fuser roller in an electrophotographic heated imaging apparatus such as a printer, copier, facsimile machine, or other any other devices which employ a fuser roller in thermal imaging applications. In the preferred mode of the invention, the apparatus is designed so as to be capable of dressing the fuser roller of a heated electrophotographic imaging device with a release oil in an even and uniform manner without the undesirable drawbacks known as streaking or dumping which are described above. In the preferred embodiment of the invention, such as shown in FIGS. 1 and 2, an oil metering supply apparatus 10 is provided which preferably is comprised of a tank reservoir 12 having an internal chamber 14 capable of housing a suitable release oil (not shown) such as silicone oil or any other conventional oil used to retard or eliminate sticking of paper or other recording medium to a fuser roller. The tank reservoir 12 is preferably comprised of a long-lasting resilient material such as metal or a high-temperature plastic resin which can be constructed into the desired geometric shape. As one of ordinary skill in this art would recognize, there are numerous types of metals and plastic resins that will be suitable for use in the apparatus of the present invention. However, it is particularly preferred that the tank reservoir be made of a material such as aluminum, steel or other suitable metals, or a plastic resin such as a glass-filled nylon.

In the preferred embodiment, tank reservoir 12 will have a series of perforations or holes 16 in order to allow the release oil to pass from inner chamber 14 to the outer surface of the tank reservoir 12. As would be recognized by one skilled in the art, a variety of patterns and spacings of the holes will be suitable to achieve the proper application of the release oil from the reservoir 12 to the fuser roller, but it is preferred that the holes or perforations be uniformly spaced in a symmetrical pattern around the circumference of the tank reservoir so as to allow an even distribution of the release oil onto the fuser roller. Generally, the number of perforations will range from about 8 to 30, depending on the size of the tank reservoir. In addition, the number of perforations will be related to their size, which should be sufficient to allow a suitable quantity of the release oil to be applied to the fuser roller as necessary, and it is preferred that the perforations range in size from about 0.5 mm to 3.0 mm in diameter.

In the preferred embodiment, such as the one shown in FIGS. 1 and 2, the oil metering supply device 10 of the present invention is preferably designed in the form of a cylindrical tube that is sealed at the ends so as to provide an interior chamber 14 which houses the supply of release oil. In this fashion, the cylindrical oil metering supply device 10 can be disposed in direct contact with the cylindrical fuser roller 40 and be capable of rotating in the opposite direction as the fuser roller, such as shown in FIG. 2. In this manner, release oil from the device 10 can be directly and evenly applied to fuser roller 40. The design of the tank reservoir of the present invention is thus advantageous in that it will hold a large volume of oil when compared to other rollers and pads of similar dimensions, which will increase the life of the part. The tank reservoir can also provide more oil in a smaller space than other oil supply devices, and also can be recycled or refilled with the fluid medium when necessary in a manner not previously obtainable. Although the ultimate capacity of the tank reservoir of the present invention will obviously be dependent in part on the overall size of the imaging device, the capacity of the reservoirs of the present invention preferably ranges from about 20 ml to about 200 ml in volume.

Figure 4:
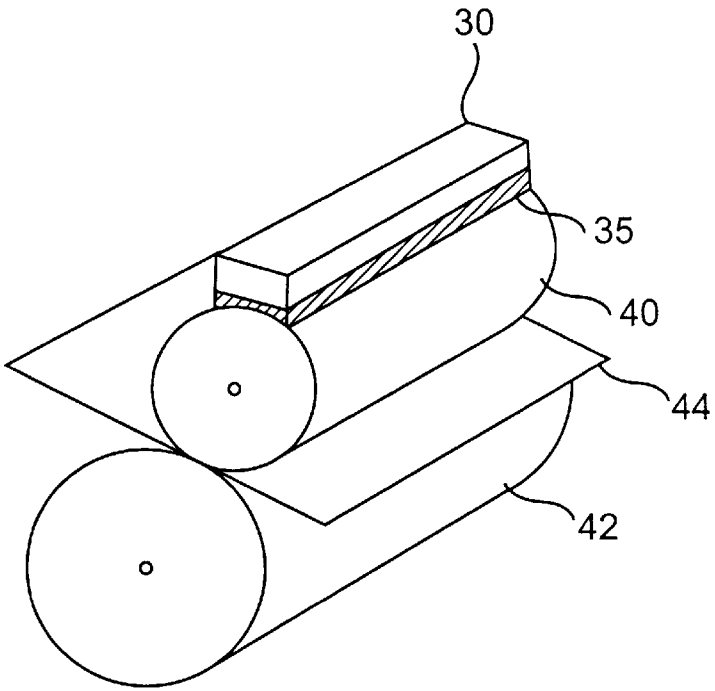
FIG. 4 is partial perspective view which shows the portion of an electrophotographic imaging device incorporating the alternative embodiment of the present invention.
Figure 3:
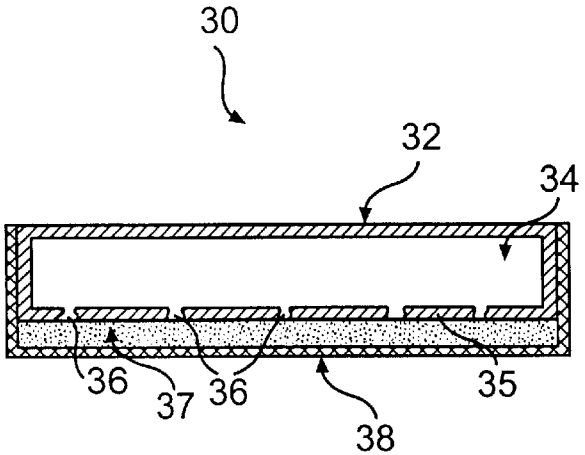
FIG. 3 is a side cross-sectional view of an alternative embodiment of the present invention.

Alternatively, the tank reservoir may be configured in any other suitable geometrical pattern which will allow for the delivery of oil from the reservoir to the fuser roller, yet which will also provide a large volume of oil when compared to other pads of similar dimensions. For example, the tank reservoir may be formed in the shape of an elongate rectangular container 30, as shown in FIGS. 3 and 4, and this alternative embodiment which will be described in more detail below.

In the preferred embodiment of the apparatus of the present invention, as shown in FIG. 1, the exterior surface of tank reservoir 12 will preferably be wrapped with an oil distribution layer 17 which allow the oil to flow outwardly from the chamber 14 of the reservoir and be evenly distributed along the surface of the fuser roller. It is preferred that the oil distribution layer be comprised of a substrate such as a thermal-bonded temperature-tolerant non-woven fabric, or any other material that would be suitable for ensuring an even distribution of oil over the fuser roller. Suitable non-woven fabrics for use in the invention would include those classified as hydro-entangled, thermally-bonded, resin-bonded and needle felt fabrics and other similar materials.

Finally, over the outer surface of the tank reservoir 12, there is provided a liquid permeation control layer 18 which will completely surround the oil distribution layer 17 and which will further ensure the proper metering of the release oil onto the fuser roller. In the preferred embodiment, the permeation control layer 18 is comprised of porous expanded polytetrafluoroethylene, but other materials such as other temperature-resistant porous films and membranes will also be suitable for use in the invention. Both the liquid permeation control layer 18 and the oil distribution layer 17 will have a thickness that will be suitable to allow proper metering of the release oil onto the fuser roller when the device 10 is employed, and the thicknesses will obviously depend upon the types of materials being employed and the size and dimensions of the imaging apparatus. However, the thickness of the oil distribution layer will preferably be in the range of about 0.1 mm to 1.0 mm, and the thickness of the liquid permeation control layer will preferably be in the range of about 0.0001 to 0.005 inches.

When used in conjunction with a suitable thermal imaging device, of which the relevant portion 50 is shown generally in FIG. 2, the oil metering supply device 10 of the present invention is preferably disposed so as to be rotatable around an axis and is placed in direct contact with or in close proximity to a fuser roller 40 which will also be in rotatable contact with a pressure roller 42, such as shown in FIG. 2. As also indicated in FIG. 2, in this configuration the fuser roller 40 will rotate in a manner opposite to that of both the oil metering supply device 10 and the pressure roller 42. In the thermal imaging process, the image is transferred to a recording medium such as a plain piece of paper 44, and this paper is directed to travel between the fuser roller 40 and the pressure roller 42 so that the image is permanently affixed to the paper 44 before it leaves the imaging device. By a suitable application of a release oil from the oil metering device 10, the present invention will be utilized to reduce or eliminate the tendency of the paper 44 to stick to heated fuser roller 40 and thus ensure the proper functioning of the imaging device.

In an alternative embodiment 30 of the present invention, the tank reservoir of the oil metering device of the present invention may be in the form of geometric shapes other than a cylindrical tube including, for example, the elongate rectangular container 32 as shown in FIGS. 3 and 4. In this embodiment, the rectangular tank reservoir 32 includes an interior chamber 34 which will house the release oil, and will preferably have holes or perforations 36 only on its lower surface 35, the side of the device that will be directly in contact with the fuser roller. As one skilled in the art would recognize, this design could be used, for example, in imaging applications that currently use a pad for an oil supply source but which need a larger oil supply for increased part life or volume without changing the size of the part. As with the embodiment described above, the elongate container 32 can be fabricated from any suitable metal or any high temperature plastic resin that can be constructed with the required geometry.

In this alternative embodiment, the lower surface 35 of container 32 which has holes or perforations 36 is then covered with an oil distribution layer 37 and a liquid permeation control layer 38 in order to meter the flow of the release oil onto the fuser roller 40. The oil distribution layer 37 and liquid permeation control layer 38 are preferably of the same dimensions and materials as the distribution layer 17 and control layer 18, respectively, as described above, with the only difference being that layers 37 and 38 will be constructed so as to cover only the lower surface of the alternative tank reservoir 32, and not the entire reservoir as in the previous embodiment. In use, the elongate rectangular metering device 30 is preferably placed in direct contact with a fuser roller 40 so that the lower surface 35 of the device 30 is directly in contact with the fuser roller, such as shown in FIG. 4. In this configuration, device 30 will be essentially stationary, and the fuser roller 40 will be dressed with an evenly distributed amount of release oil by virtue of its contact with the lower surface of device 30 during the rotation of roller 40. In this embodiment, once again the fuser roller 40 will be directly in contact with a second roller, such as pressure roller 42, and an image will be permanently fixed upon recording medium 44 as it passes between heated fuser roller 40 and pressure roller 42. Accordingly, in this embodiment, the application of the release oil by the oil metering device 30 reduces or eliminates the tendency of the paper 44 to stick to heated fuser roller 40 and thus ensures the proper functioning of the imaging device.

In both of the above embodiments, therefore, an even distribution of release oil is applied to a fuser roller in order to keep the recording medium from sticking to the fuser roller, and the amount and duration of the application of the release oil will be designed so as to provide the proper quantity of release oil for the desired application. In these embodiments, the release oil will travel from the tank reservoir through the oil distribution layer and liquid permeation control layer in order to be evenly distributed upon a fuser roller in contact with, or in close proximity to, the outer surface of the tank reservoir. Through the use of the apparatus and method of the present invention, it is thus possible to achieve even and uniform distribution of a release oil onto a fuser roller without problems such as streaking and dumping, and the design of the present invention will allow for an oil metering supply device having an increased volume as compared to prior devices of similar dimensions, which will greatly increase the life of the part and maximize the cost-effectiveness of the imaging apparatus.

It is thus submitted that the foregoing embodiments are only illustrative of the claimed invention, and alternative embodiments not specifically set forth above that would be obvious to one skilled in the art also fall within the scope of the invention which is defined in accordance with the claims appended hereto.

What is claimed is:

1. An oil metering supply apparatus for applying an evenly distributed release oil onto a fuser roller comprising:

(a) a tank reservoir having an interior chamber capable of retaining and delivering a release oil;

(b) an oil distribution layer surrounding the tank reservoir which can evenly distribute a layer of release oil along the outer surface of the tank reservoir; and (c) a liquid permeation control layer comprising porous expanded polytetrafluoroethylene surrounding the oil distribution layer which can evenly distribute a layer of release oil onto a fuser roller.

2. An oil metering supply apparatus according to claim 1 wherein the tank reservoir comprises a cylindrical tube having sealed ends.

3. An oil metering supply apparatus according to claim 1 wherein the tank reservoir has perforations to allow oil to flow from the interior storage chamber of the tank reservoir to its outer surface.

4. An oil metering supply apparatus according to claim 1 wherein the oil distribution layer is comprised of a thermal-bonded temperature tolerant non-woven fabric.

5. An oil metering supply apparatus according to claim 1 wherein the liquid permeation control layer is comprised of porous expanded polytetrafluoroethylene film.

6. An oil metering supply apparatus according to claim 1 wherein the tank reservoir is in the form of an elongate rectangular container.

7. An oil metering supply apparatus according to claim 1 wherein the tank reservoir is comprised of a metal or a high temperature plastic resin.

8. A method of applying a layer of release oil onto a fuser roller comprising:

(a) providing a tank reservoir having an interior chamber containing a release oil, an oil distribution layer surrounding the tank reservoir, and a liquid permeation control layer comprising porous expanded polytetrafluoroethylene surrounding the oil distribution layer;

(b) causing the release oil to flow from the interior chamber of the tank reservoir outwardly through the oil distribution layer and liquid permeation control layer so that the release oil can be evenly distributed onto a fuser roller in contact with or in close proximity to the tank reservoir.

9. A method according to claim 8 wherein the oil distribution layer is comprised of a thermal-bonded temperature tolerant non-woven fabric.

10. A method according to claim 8 wherein the liquid permeation control layer is comprised of porous expanded polytetrafluoroethylene film.

11. A method according to claim 8 wherein the tank reservoir is comprised of a metal or a high temperature plastic resin.

* * * * *